United States Patent [19]

Gustavsson et al.

[11] 4,377,104

[45] Mar. 22, 1983

[54] LOADING TRAY

[75] Inventors: Olle Gustavsson; Göran Sundmar, both of Karlskoga, Sweden

[73] Assignee: Aktiebolaget Bofors, Bofors, Sweden

[21] Appl. No.: 217,637

[22] Filed: Dec. 18, 1980

[30] Foreign Application Priority Data

Dec. 18, 1979 [SE] Sweden ..... 7910439

[51] Int. Cl.[3] ..... F41F 9/00

[52] U.S. Cl. ..... 89/45

[58] Field of Search ..... 89/33 BC, 45, 47

[56] References Cited

U.S. PATENT DOCUMENTS

| | | | |
|---|---|---|---|
| 2,464,920 | 3/1949 | Carter | 89/33 BC |
| 3,598,016 | 8/1971 | Chiabrandy et al. | 89/47 |
| 4,135,433 | 1/1979 | Hultgren et al. | 89/47 |

*Primary Examiner*—Stephen C. Bentley

*Attorney, Agent, or Firm*—Pollock, Vande Sande & Priddy

[57] ABSTRACT

A loading tray (3) used for a loading unit (4) which can be swung in from the side from a feeding position for an ammunition unit, (6) to a swung-in position in the extension of the axis of the bore (2) of a firearm (1). The loading tray receives the ammunition unit fed in from the side, and supports the ammunition unit during the swinging-in process, and permits longitudinal displacement out of the loading tray by means of a rammer (8). The loading tray has an elongate element (16) which having received the ammunition unit extends above and along the ammunition unit. The element can spring away to the side temporarily in connection with the rolling of the ammunition unit. The element (16) is comprised in the holding function for the ammunition unit under the swinging-in process, and serves as a rearing guard during ramming of the ammunition unit.

11 Claims, 11 Drawing Figures

Fig 6 (sec. B—B)

Fig 5 (sec. A—A)

Fig 7 (sec. C—C)

16
3
U2
B
16b
U1
A
16a
12
11
10
28
28a
9
9e
9d
9f
6'
6a
6b
9a
9b
14
14a
15
12a''
26a
18
19
26
12a'
26b
27
12a

LOADING TRAY

TECHNICAL FIELD

The present invention relates to a loading tray belonging to a loading unit which can be swung in from the side, such as a loading pendulum, which in a side position of an artillery piece receives an ammunition unit, a shell laterally displaced into the loading tray, to support the ammunition unit during the swinging-in process of the loading unit to a swung-in position in the extension of the axis of the bore of the piece. In the swung-in position coaction between the ammunition unit and a rammer for the longitudinal displacement of the ammunition unit out of the loading tray is permitted.

The new loading tray can be used on an artillery piece, such as a field howitzer with a large calibre.

BACKGROUND ART

It is previously known to utilize a loading tray applied on a loading pendulum of a field howitzer, on to which an ammunition unit, a shell or the like, can be fed, from a loading table. The loading pendulum is arranged so that after receiving the ammunition unit it assumes a position corresponding to the prevailing angle of elevation, after which a swinging in from the side of the firearm to the position coinciding with the extension of the axis of the bore takes place. After the swinging in, the shell thus swung in with the loading tray is displaced longitudinally out of the loading tray by means of the rammer.

DISCLOSURE OF THE INVENTION

Because of the comparatively heavy shell or the like, and due to the fact that the loading process shall take place as rapidly as possible, comparatively great acceleration forces are required in connection with the ramming. This involves special requirements for the rammer tooth coacting with the shell on the rammer and the holding of the shell by the loading tray, during the swinging-in process from the side position to the swung-in position.

The purpose of the present invention is to create a loading tray which solves the above-mentioned problems. The new loading tray comprises an elongate element extending in the longitudinal direction of the loading tray which element at the receiving of the ammunition unit can be caused to spring aside by means of the ammunition unit. The element after the ammunition unit has been received springs back and assumes a position above and along the ammunition unit, and that the element is arranged to be included in the fixing of the ammunition unit in the longitudinal direction in the loading tray during the swinging-in process, and also during the longitudinal displacement of the ammunition unit out of the loading tray to serve as a rearing guard for the ammunition unit.

In further developments of the invention, the design and suspension of said element, and also its coaction with an ammunition unit applied in the loading tray, are proposed. Details of the designs of the other parts of the loading tray coacting with the ammunition unit are also indicated.

The features that can mainly be considered to be characteristic for a loading tray according to the invention will be noted from the following claims.

Through the above-mentioned arrangement, the movable part of the rammer tooth can be applied to the rear surface of the shell at its lowest point, which requires moment forces acting upon the movable part of the rammer be kept comparatively low, and also that the movable part be inclined at an angle rearwards, which together with the low point of application reduces the load on the support for the movable part. This, in turn, results in reliable functioning and makes frequent service intervals unnecessary. The element will contribute towards the ammunition unit being retained in the loading tray during the process of swinging in, and at the end of the process, the ammunition unit is prevented from sliding out of the loading tray because of the necessary comparatively great retardation forces. In this way it will remain in a distinct starting position for the forthcoming ramming function of the shell. Through its position, the element will also serve as a holding element for the shell in connection with the recoil forces in the firearm when firing takes place of rammed ammunition units and at the same time the new ammunition unit has been fed into the loading tray.

The design proposed in accordance with the invention also involves a technically simple solution of a major complex of problems in connection with a more rapid and to a great extent automatized loading procedure for a field artillery piece.

BRIEF DESCRIPTION OF DRAWINGS

An embodiment proposed at present of a loading tray which has the characteristics significant for the invention will be described in the following, with reference to the accompanying drawings, in which FIG. 1 in a horizontal view shows an explanatory sketch of a loading procedure for a firearm, FIG. 5 shows in a vertical section along the line A—A in FIG. 2 the design of the loading tray in the section, FIG. 6 shows a vertical section along the line B—B in FIG. 2 the design of the loading tray in the section, FIG. 7 shows in a horizontal section along the line C—C in FIG. 2 the design of a supporting part.

BEST MODE OF CARRYING OUT THE INVENTION

Figure 6A:
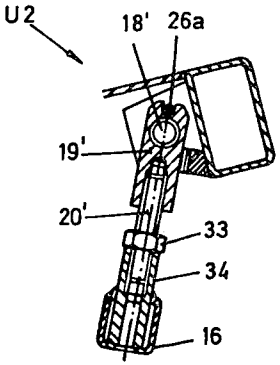
FIG. 6*a* shows in an enlargement the parts shown in FIG. 6.
Figure 1:
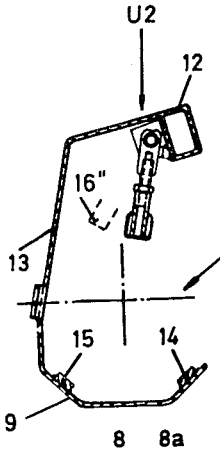
Figure 1:
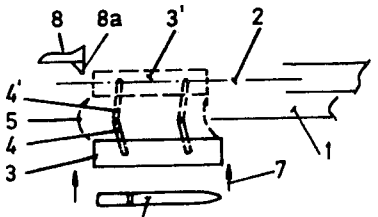
Figure 4:
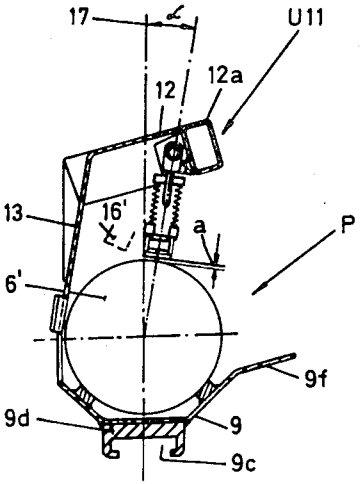
Figure 4:
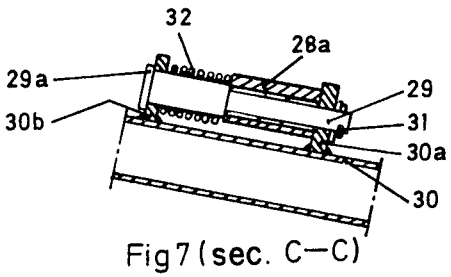
Figure 4:
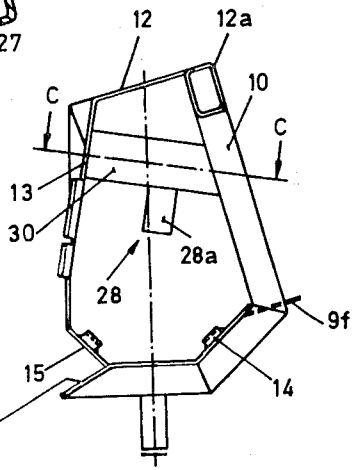

In FIG. 1, a firearm which is known in itself, e.g. a field howitzer, is indicated by the numeral 1, the axis of the bore of the weapon then being shown by 2. The new loading tray which is utilized in the loading system of the firearm 1 is indicated by 3 and 3', 3 shows the side position of the loading tray at the rear parts of the firearm, and 3' shows a swung-in position in the extension of the axis of the bore 2 of the firearm.

The loading tray is arranged in a way which is known on a loading unit which in the example of the embodiment consists of a loading pendulum, which is symbolized by its two arms 4 and 4' supporting the loading tray. The numeral 4 shows the position of the loading tray swung to the side and 4' shows the position of the swung-in loading tray. The loading pendulum is of the kind which after receiving the ammunition unit first adjusts itself to the angle of elevation of the firearm and can thereafter be swung in laterally. The direction of the swinging-in of loading tray is shown by 5. The loading tray is arranged to receive an ammunition unit 6 rolled in from the side or dropped from the side in the direction of the arrow 7. The loading tray supports the ammunition unit during the swinging-in process to the position 3', in which there shall be a distinct longitudinal displacement position for the ammunition unit when the ramming process by means of a rammer 8 commences. The loading tray thus permits coaction between the ammunition unit and the rammer, which in the example of the embodiment coacts with the ammunition unit via a tooth 8*a* which can be raised and lowered, and which is known.

Figures 2, 3, 3A, 3B:
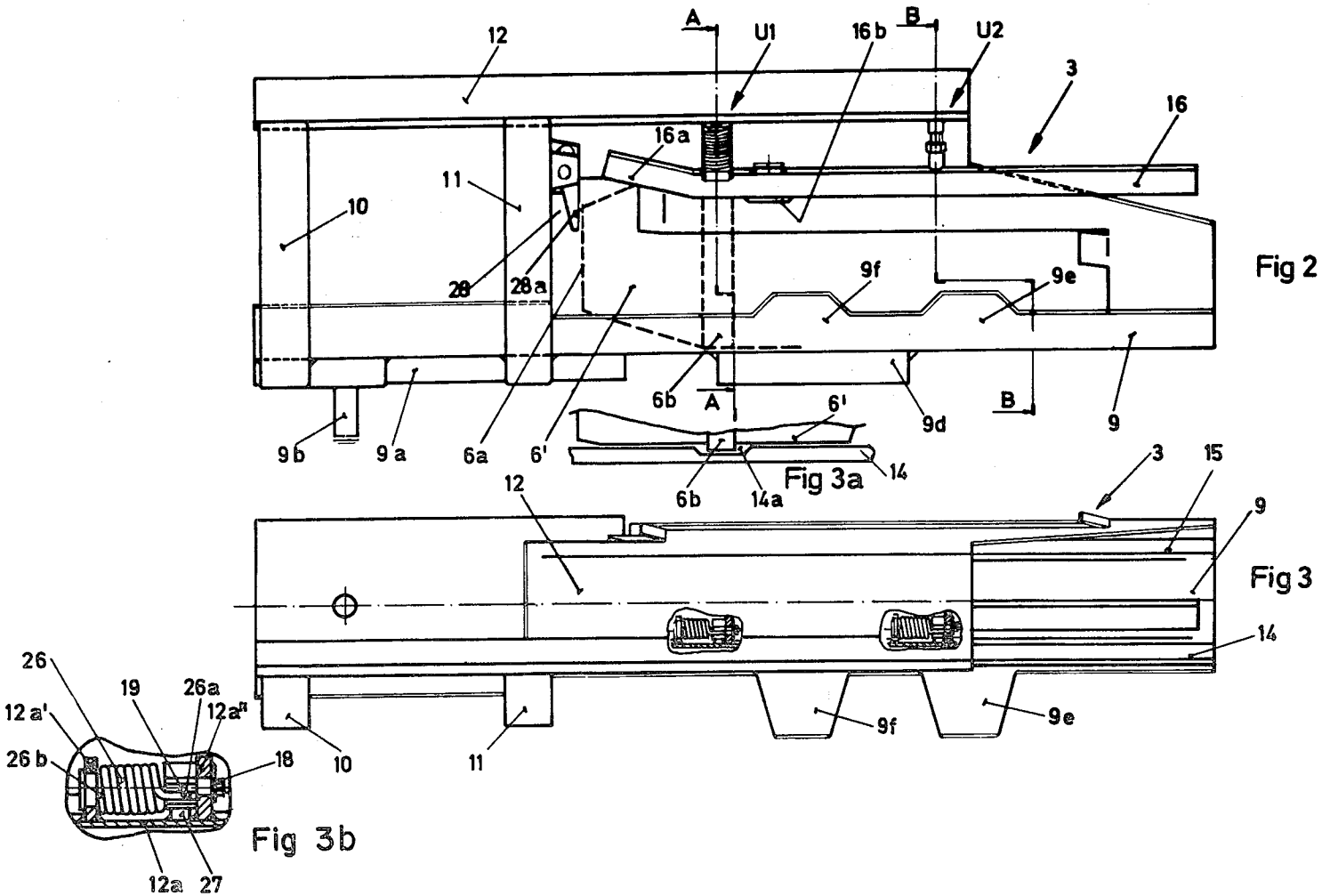
FIG. 2 shows the new loading tray from the side.
FIG. 3 shows in a view from above and partly in cross-section the loading tray according to FIG. 2.
FIG. 3*a* shows parts of the loading tray according to FIG. 3, FIG. 3*b* in cross-section shows further details of the loading tray according to FIG. 3, FIG. 4 in an end view from the rear shows the loading tray according to FIG. 2.

In accordance with FIGS. 2–6*a* the loading tray has a bottom part 9 which is angular and/or curved in its cross-section, but in its longitudinal direction is substantially straight, and at the rear has side parts 10 and 11, to which an upper part 12 is fastened. To the upper ends of the side parts 10 and 11 there is then fastened a longitudinal beam 12*a*. On the side opposite side parts 10–11 the upper part 12 goes over to a further side part 13 which at its bottom is connected to the bottom part 9. The side part 13 extends along the entire length of the loading tray, while the upper part 12 extends to the rear end of the loading tray and ends at a distance from the front end of the loading tray which is approx. $\frac{1}{4}$–1/5 of the total length of the loading tray. The side parts 10 and 11 are located at the rear parts of the loading tray, and said parts are then also made in such a way that the ammunition unit 6' can be dropped or rolled in its lateral direction obliquely from above one side of the loading tray in a direction which is indicated by the arrow P in FIGS. 5 and 6. In its position in the loading tray the ammunition will be placed entirely in front of the side parts 10 and 11, as shown in FIG. 2, in which the rear surface of the ammunition unit has been indicated by 6*a*.

The frame of the loading tray is formed by the bottom part, the sturdy side parts 10 and 11, and over these the beam 12*a*, which like the other parts can consist of some appropriate metal alloy. The bottom part 9 has a turned down side edge 9*a* which serves as a receiving support for a rammer unit not shown, with which the loading tray is intended to coact in an automatic loading function.

The loading bridge is supported on the arms of the loading pendulum, via a journal 9*b* extending downwards, and also via a longitudinal supporting groove 9*c* (FIG. 5) in a supporting part 9*d*. At its inlet side the loading tray also has protruding lips 9*e*, 9*f*, which extend obliquely upwards to facilitate the rolling or dropping of the ammunition unit from a loading table or the like.

On the inside of the bottom part there are arranged two longitudinal slide means, e.g. slide rails 14 and 15, on which the ammunition unit can be displaced longitudinally out of the loading tray. Of said slide rails, the slide rail 14 extends only partly rearwards, and does not go into the rear part of the loading tray. In the present example of the embodiment, the ammunition unit is assumed to consist of a shell with a driving band 6*b*. For the driving band the longitudinal rails are made with recesses 14*a*, into which the driving band can sink when the ammunition unit is inserted in the loading tray, so that the shell with a large contact surface for the rest can bear against the upper surfaces of the slide rails along its longitudinal direction.

In the loading tray there is arranged a longitudinal element 16 which has the cross-section form of a low rectangle (or rather a bar) and which is angular at its rear end 16*a*. The element extends from a position in front of the side part 11 and up to the front end of the loading tray.

Figure 5A:
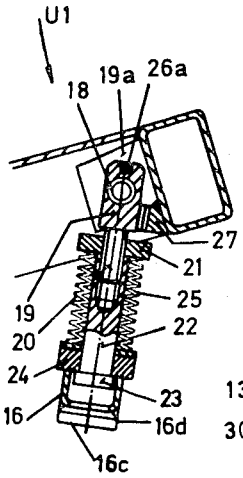
FIG. 5*a* shows in an enlargement the parts shown in FIG. 5.

The element is suspended in the upper part of the loading tray, at the beam 12*a*, at two suspension points U1 and U2. The suspension points are then arranged so that the element is pressed aside by the ammunition unit when this is rolled into the loading tray. In FIGS. 5 and 6 the side position at the swinging in from the side has been indicated by 16' and 16'' and the reason for the ability to swing in from the side is that the diameter of the ammunition unit exceeds the distance between the bottom part, at the lips 9*e* and 9*f* and the slide rail 14, and the under surface of the element when the element is in its starting position, as shown by the solid lines in FIGS. 5 and 6.

When the ammunition unit has been rolled or dropped, the element has sprung back to its starting position since the pressing force from the ammunition unit ceases, and it will then extend above and along the ammunition unit in the longitudinal direction.

In the cross-section according to FIGS. 5 and 6 the element is set somewhat obliquely in relation to the vertical 17 to the loading tray. The inclination is from the outside and inwards, and an angle $\alpha$ between a center line through the cross-section of the element and the vertical 17 is then between 5° and 15°, particularly approx. 10°.

When the ammunition unit has been inserted in the loading tray with the driving band in the recesses 14*a* in the rails 14, 15, there is a play a between the upper surface of the ammunition unit and the under surface of the element, which play somewhat exceeds the thickness of the driving band, and in the example of the embodiment has been chosen to be approx. 1.6 mm.

In connection with or somewhat in front of the suspension point U1, the element has a cleat 16*b* extending below the under surface of the element, and which has obliquely chamfered end surfaces. When the driving band leaves the recesses 14*a* in the rails 14, 15, the driving band must pass the cleat 16*b* in order to leave the loading tray. In this way, efficient securing is obtained against lateral and/or longitudinal displacement movements of the ammunition which can occur at the swinging-in movements of the loading tray, recoil movements of the firearm.

However, in order that longitudinal displacement of the ammunition unit out of the loading tray shall be possible, the element is arranged at the suspension point U1 so that it can carry out a springing upwards movement so that the ammunition unit can press the element upwards so that the driving band can pass by the cleat. When the driving band has passed by the cleat 16*b*, the element springs back again to its starting position, after which there will be a remaining play between the upper surface of the driving band and the lower surface of the element, and thereafter the element cannot brake the ammunition unit in its continued displacement movement, but only guides the ammunition unit and prevents its nose section from striving upwards from the bottom part of the loading tray, which gives an appropriate ramming function.

In order that the retention shall be possible, and that it shall also be possible to displace the ammunition unit out of the loading tray, the cleat 16*b* and the recess 14*a* in the rails 14, 15, are adapted in such a way in relation to each other in the longitudinal direction of the loading tray that when the driving band is displaced longitudinally out of the recesses 14*a*, it will at the same time go into coaction with the cleat 16*b*. As long as the driving band remains in said recesses, it will not come into contact with the cleat 16*b*.

The retaining force for the longitudinal displacement out of the loading tray is thus the result of first friction and/or hooking forces between the driving band and rails at the recesses 14*a* and second friction and/or hooking forces between the driving band and the cleat 16*b*, which second friction and/or hooking forces are determined, inter alia, by the radial spring force in the suspension point U1. Said first and second friction and/or hooking forces are overcome by the ramming force from the rammer at the ramming process.

The suspension point U1 comprises a washer 19 rotatably supported on a journal 18. At its lower end the washer is fixed to a journal 20 extending downwards, and on the last-mentioned journal there is arranged a fixed flange 21. On the journal 20 a cylinder 22 is fastened, which at its free end is made with a fixed head 23. Movably on the cylinder and with its end position limited by the head a washer 24 is arranged, to which the element 16 is fastened. Between the washer 24 and the flange 21, a spring washer 25 is inserted. When the ammunition unit presses at right angles against the lower surface 16*c* of the element, the element and the washer connected to it are displaced upwards against the action of the spring 26, which when the pressing force from the ammunition unit ceases, presses back the washer 19 and the element 16 to its starting position, which is determined by the washer resting against the head 23.

On the other side of the journal 18 on the washer 19 the washer has a recess 19*a*, in which is one end of a torsion spring which is shown in more detail in FIGS. 3 and 3*b*, in which the torsion spring has the designation 26, and the end of the torsion spring supported in the washer 19 has the designation 26*a*. The torsion spring and the washer 19 are arranged between two outriggers 12*a*' and 12*a*'' from the beam 12*a*. At its other end 26*b* the torsion spring 26 is fastened in the outrigger 12*a*', and the fastening of the spring end 26*b* can be carried out in a way which is known in itself, by clamping or the like. The journal 18 is supported in the other outrigger 12*a*'', to which the washer 19 thus can be swung. On one surface of the beam 12*a*, a stop 27 is fastened, by gluing, against which the torsion spring strives to hold the washer 19.

The suspension between the washer 19 and the torsion spring 26 provides for the element springing to the side when the ammunition unit is pressed against the surface 16*d* of the element in connection with its being rolled or dropped into the loading tray. At a pressing force against the surface 16*d* the element and the washer fastened to it around the journal 18 are actuated to turn at an angle against the action of the torsion spring 26. When the pressing force from the ammunition unit ceases the torsion spring presses the washer and the element back again against the stop 27, so that the element assumes its starting position.

The loading tray also has a spring stop 28 which can coact with the rear surface of the ammunition unit and at this coaction prevents the ammunition unit from sliding rearwards, at the initial stage of the swinging-in process. The stop comprises a coaction part 28*a* which in accordance with FIG. 7 is movably supported on a shaft arranged at two outriggers 30*a* and 30*b* on a transversal part 30 arranged in the loading tray. The supporting shaft has a head 29*a*, by means of which it is secured to the outriggers together with a split pin 31. On the shaft 29, at the side of the part 28*a*, there is also supported a further torsion spring 32 which has one end fastened in the outrigger 30*b* and its other end coordinated with the part 28*a* so that the torsion spring 32 strives to keep the part 28*a* in its starting position. At the impact of the rear surface against the part 28 this is actuated against the action of the torsion spring 32, which in this way gives a soft impact against the part 28*a* for the ammunition unit.

As regards the second suspension point U2 for the element 16, in accordance with the above, this is made for the same capability of swinging to the side, and in this respect it has an identical design, with the journal 18', the washer 19' and a torsion spring corresponding to the torsion spring 26, with the spring end 26*a*'. The corresponding parts in the two suspension points U1 and U2 have thus been given corresponding reference designations, which, however, in the suspension point U2, have been complemented with prime signs.

On the other hand, the suspension point U2 is not capable of springing aside vertically, and therefore the element 16 is screwed to the journal 20' of the washer 19' via a nut 33 which is arranged to a fixed part 34 belonging to the element.

The journal 20, 20' in the washer 19, 19' is threaded, and the cylindrical part 22 and the nut 33 with its part 34 can be screwed on to the journal to varying degrees, giving a possiblity of fine adjustment of the play between the lower surface 16*c* of the element and the upper surface of the ammunition unit.

The invention is not limited to the embodiment shown above as an example, but can be subject to modifications within the scope of the following claims defining the invention.

INDUSTRIAL APPLICABILITY

The loading tray consists of parts which are easy to manufacture and assemble and the manufacture can take place separately or integrated with the firearm to which the new loading tray is intended. The loading tray can be applied to firearms which are being manufactured and to firearms which are already in service.

We claim:

1. In a large calibre firearm having a loading unit positionable from a first ammunition unit receiving position, to a laterally displaced loading position along the extension of the axis of said firearm bore, wherein a rammer unit displaces said ammunition unit into said firearm, a loading tray for holding said ammunition unit comprising:

a longitudinal extending tray portion having longitudinal side portions connected to a bottom portion, one of said side portions extending vertically and thence laterally over top of said bottom portion, said side portions and bottom portions open to receive an ammunition unit; and an elongate element suspended to said side portion lateral extension for rotation, through spring means in a direction of said side portions, whereby during movement of said loading tray towards said loading position said elongate element fixes said ammunition longitudinally, and during a subsequent ramming function serves as a rearing guard for the ammunition.

2. A loading tray according to claim 1, in that the elongated element is suspended at two suspension points which are separate in relation to each other, and the respective suspension points includes a torsion spring which urges the element in a starting position, from which it springs away to the side momentarily by means of the ammunition unit.

3. A loading tray according to claim 2, wherein the first suspension point of said suspension points also comprises a spring device providing a spring biased movement of the element along its longitudinal direction.

4. A loading tray according to claim 3, wherein the element at the fastening place for the spring device includes means which can coact with a driving band on the ammunition unit.

5. A loading tray according to claim 4, further including slide rails on which the ammunition unit can rest and be displaced longitudinally, said slide means having recesses at the position of the driving band of the ammunition unit.

6. A loading tray according to claim 5, wherein the ammunition unit driving band is placed into said recesses, said rammer at the ramming of the ammunition unit forcing the driving band out of said recesses.

7. A loading tray according to claim 6, wherein the element is positioned above and along the ammunition unit with a small space between.

8. A loading tray according to claims 5, 6 or 7, wherein said means on the element which can coact with the driving band is arranged so that when the driving band leaves said recesses at the longitudinal displacement of the ammunition unit by the rammer, and the ammmunition unit is thereby raised towards the element, said means on the element go into coaction with the driving band, and that at the continued longitudinal displacement of the ammunition unit the driving band forces the element upwards against said spring device and the ammunition is fixed in the longitudinal direction in the loading tray.

9. A loading tray according to claim 2 wherein the respective suspension point comprises a washer rotatably arranged on a journal and that the washer is connected at its lower ends to the element and at its upper ends, which are located on the other side of the journal in relation to said lower parts, is connected to the relevant torsion spring.

10. A loading tray according to claim 2, further comprising a springloaded means which can abut with the rear surface of the ammunition unit.

11. In a large calibre firearm having a loading unit positionable from a first ammunition receiving position to a laterally displaced loading position along the extension of the axis of said firearm bore, wherein a rammer unit displaces said ammunition unit into said firearm, a loading tray for holding said ammunition unit comprising:

a longitudinal extending tray having longitudinal side portions connected to a bottom portion;

side supports at a rear end of said tray bottom portion extending upwards and supporting an upper part over said bottom portion, said upper part extending from said rear end of said bottom portion towards an opposite front end, said upper part having a side portion continuous with one of said tray side portions;

an elongate element pivotally suspended from said upper part at first and second suspension points, said element being pivotal against torsion springs in a plane perpendicular to the longitudinal axis of said loading tray; and a spring loaded stop mounted to said side supports for abutting an end of said ammunition unit, whereby when said tray is in a loading position, an ammunition unit is received between said bottom portion and side portions and said elongate element is swung aside until said ammunition unit rests on said bottom portion wherein it assumes a return position over said ammunition unit.

* * * * *